US010322842B2

(12) United States Patent
Kohn et al.

(10) Patent No.: US 10,322,842 B2
(45) Date of Patent: Jun. 18, 2019

(54) MULTI-PIECE DEVICE FOR MOVING AND STORING POTTED PLANTS AND OTHER OBJECTS HAVING A BASE

(71) Applicants: Steve Kohn, Short Hills, NJ (US); Amy Rigazio, Farmingdale, NJ (US)

(72) Inventors: Steve Kohn, Short Hills, NJ (US); Amy Rigazio, Farmingdale, NJ (US)

( * ) Notice: Subject to any disclaimer, the term of this patent is extended or adjusted under 35 U.S.C. 154(b) by 0 days.

(21) Appl. No.: 15/456,492

(22) Filed: Mar. 11, 2017

(65) Prior Publication Data

US 2018/0178949 A1 Jun. 28, 2018

Related U.S. Application Data

(63) Continuation-in-part of application No. 15/391,787, filed on Dec. 27, 2016.

(51) Int. Cl.

| | |
|---|---|
| ***B65D 5/48*** | (2006.01) |
| ***B65D 5/49*** | (2006.01) |
| ***B65D 5/50*** | (2006.01) |
| ***B65D 85/52*** | (2006.01) |

(52) U.S. Cl.

CPC ..... *B65D 5/48026* (2013.01); *B65D 5/5038* (2013.01); *B65D 85/52* (2013.01)

(58) Field of Classification Search

CPC . A01G 9/02; B65D 5/50; B65D 5/503; B65D 5/505; B65D 5/52; B65D 25/04; B65D 25/108; B65D 25/00; B65D 25/004; B65D 25/02; B65D 25/10; B65D 61/00; B65D 5/48; B65D 5/48026; B65D 5/5038; B65D 85/52; A47G 7/00; A47G 7/06

USPC ..... 47/73–78, 83–87; 206/423, 763, 765; 229/122.23, 122.29, 122.31; 211/72, 73

See application file for complete search history.

(56) References Cited

U.S. PATENT DOCUMENTS

| | | | | | |
|---|---|---|---|---|---|
| 2,623,682 | A | * | 12/1952 | Candell | B65D 5/5038 206/563 |
| 3,375,934 | A | * | 4/1968 | Bates | B01L 9/06 211/72 |
| 4,621,733 | A | * | 11/1986 | Harris | B65D 85/52 206/423 |
| 4,726,468 | A | * | 2/1988 | Hesser | B65D 5/5011 206/423 |
| 4,819,803 | A | * | 4/1989 | Neiser | B65D 85/52 206/423 |
| 5,095,649 | A | | 3/1992 | Brownlee | |
| 5,186,319 | A | * | 2/1993 | Ting | B65D 5/50 206/763 |
| 5,217,117 | A | * | 6/1993 | Tsuji | B65D 85/505 206/423 |
| 5,235,782 | A | | 8/1993 | Landaw | |
| 5,315,785 | A | | 5/1994 | Avot et al. | |
| 5,454,213 | A | | 10/1995 | Gola | |
| 5,685,438 | A | * | 11/1997 | Emanuel | A47F 7/0028 206/486 |
| 5,725,109 | A | * | 3/1998 | Moulton | B65D 71/72 211/73 |

(Continued)

*Primary Examiner* — Bryon P Gehman

(74) *Attorney, Agent, or Firm* — Philip M. Weiss; Weiss & Weiss

(57) ABSTRACT

A device for securely transporting multiple objects having a base, wherein the device comprises a foundation comprising multiple pieces wherein each piece has at least one adjustable opening that allows the base of an object to sit securely within the device.

26 Claims, 16 Drawing Sheets

(56) References Cited

U.S. PATENT DOCUMENTS

| | | | | |
|---|---|---|---|---|
| 5,832,660 | A | 11/1998 | Posa | |
| 6,006,500 | A | 12/1999 | Craig et al. | |
| 6,050,412 | A * | 4/2000 | Clough | B65D 65/403 206/423 |
| 6,189,295 | B1 | 2/2001 | Craig et al. | |
| 6,546,699 | B2 | 4/2003 | Craig et al. | |
| 6,546,700 | B2 | 4/2003 | Craig et al. | |
| 6,691,445 | B2 | 2/2004 | Craig et al. | |
| 6,871,479 | B2 | 3/2005 | Craig et al. | |
| 7,080,483 | B2 | 7/2006 | Craig et al. | |
| 7,392,904 | B1 * | 7/2008 | Jackson | B65D 25/24 206/423 |
| 2005/0085365 | A1 | 4/2005 | Tchira | |
| 2016/0137328 | A1 | 5/2016 | Paynter | |

* cited by examiner

MULTI-PIECE DEVICE FOR MOVING AND STORING POTTED PLANTS AND OTHER OBJECTS HAVING A BASE

RELATED APPLICATIONS

The following is a continuation-in-part application of U.S. patent application Ser. No. 15/391,787.

FIELD OF THE INVENTION

The present invention relates to a multi-piece device for moving and storing potted plants and other objects having a base.

BACKGROUND OF THE INVENTION

U.S. Pat. Nos. 6,691,495, 6,546,700, 6,546,699 relate to a modular system for packaging articles for shipment. A potted plant is placed in a cover, then automatically deposited into a protective sleeve. The potted plant thus packaged is ready for containment within a shipping carton.

U.S. Pat. Nos. 6,189,295, 6,006,500 relate to a modular system for packaging articles for shipment. A potted plant is sorted according to a grade, placed in a decorative cover, then automatically deposited into a protective sleeve. The potted plant thus packaged is ready for containment within a shipping carton.

U.S. Pat. No. 6,871,479 relates to a modular system for packaging articles for shipment. A potted plant is placed in a cover, then automatically deposited into a protective sleeve. The potted plant thus packaged is ready for containment within a shipping carton.

U.S. Pat. No. 7,080,483 relates to a modular system for packaging articles for shipment. A potted plant is automatically deposited into a protective sleeve. The potted plant thus packaged is ready for containment within a shipping carton.

U.S. Pat. No. 5,095,649 relates to an assembly for storage of floral items which includes a housing made up of stepped sidewalls, a rear wall, a front wall section at each step and top wall sections at each step. At least one container is located at each step. The containers define at least one water drain opening associated with a water drain system. A cut item separator support may be provided within the containers for dividing the inside of the containers into a plurality of compartments for receipt of floral items therein and for water free transfer of foliage from one container to another.

U.S. Pat. No. 5,832,660 relates to a protective plant covering comprising a sheet of flexible material having two opposing side edges each with a plurality of fasteners such that with the material wrapped around the plant, the two side edges may be brought proximate to one another and adjustably fastened around the plant using the fasteners.

U.S. Pat. No. 5,235,782 relates to a cover for potted plants wherein the cover provides a water tight seal at its base while at the same time protecting the plant from water leaking out of the plant. The cover is a form of a flat, tear away bag that customers of florists and plant nurseries can use themselves without assistance.

U.S. Pat. No. 5,315,785 relates to a wrapping for plants or flowers placed in a pot like container made from a resilient material of natural rigidity and consisting of a frustoconical tubular element open at both ends, the terminal portion at the tube end of small diameter having a retaining stop shoulder extending along at least part of the circumference of the tubular element and defining a free internal opening which is smaller than that of an adjacent portion disposed in the direction of the tube end having a smaller diameter, which stop shoulder is formed by a local cut in the tubular element disposed in a plane substantially perpendicular to the central axis of the tubular element.

U.S. Pat. No. 5,454,213 relates to a method and apparatus for packing horticultural items like cut flowers and potted plants for shipment in cardboard cartons. An elongated rod extends from the top of the carton into a vase holding the horticultural items and secures the vase and horticultural items from movement inside of the carton.

U.S. Patent Publication No. 2005/0085365 relates to a system and method for creating folded flower wraps that use a plurality of molds to define one or more lines in a sheet of material for folding to produce a floral wrap by sequentially placing each one of the plurality of molds in contact with the sheet of material and folding the sheet of material across each one or more of the edges of the molds, the sheet of material is moved from the first position through a plurality of intermediate partially folded positions to the second fully folded position. The second fully folded position corresponds to the desired folded flower wrap.

U.S. Patent Publication No. 2016/0137328 relates to an automated high through-put system and method for shrink wrapping potted plants for packaging and shipping. The system provides the ability to shrink wrap plants by utilizing a conveyer system and heating area with heating units having adjustable, directional nozzle heads.

SUMMARY OF THE INVENTION

The present invention relates to a device for securely transporting multiple potted plants within a single device The present invention relates to multiple objects having a base which can each securely fit within an opening in a device and be held within the opening hi the device during storage and transport and allow transport of the multiple objects safely.

The device comprises a foundation having several openings that allow the container base of a plant holder or other objects having a base to sit securely within the device.

It is an object of the present invention for the other objects to comprise a lamp or vase.

It is an object of the present invention for the device to comprise cardboard, paperboard or another fiber based material.

It is an object of the present invention for the device to comprise plastic, or polyethylene material.

It is an object of the present invention for the openings to allow different size container bases of plant holders or other objects to sit securely within the device.

It is an object of the present invention for the openings to allow different shaped container bases of plant holders or other objects to sit securely within the device.

It is an object of the present invention for the device to securely fit within a box or container so that the box or container can be easily moved and stored.

It is an object of the present invention for the plant or body of the object to fit securely within the box or container and for a portion of the plant or body of the object to fit above the device.

It is an object of the present invention for the device to be water-proof.

It is an object of the present invention for the device to be used multiple times.

It is an object of the present invention for the device to be easily cleaned of dirt or other material from the plant holders.

It is an object of the present invention for the openings to have slits within it that can change size to hold different size container bases for the plant holders or other objects having a base.

It is an object of the present invention for the openings to have slits within it that can change size to hold different shaped container bases for the plant holders or other objects having a base.

It is an object of the present invention for the device to fit snuggly within the box or container so that there is little or no movement of the device within the box or container so that the plants or other objects are not harmed during movement of the box or container.

It is an object of the present invention for the device to be made of a foldable material to assist with the device fitting properly within a box or container.

It is an object of the present invention for the device to further comprise a divider which is inserted into the box or container above the foundation that separates the different plants or other objects from each other.

It is an object of the present invention for the device to have adjustable sides so that the device fits multiple sizes of boxes or containers.

It is an object of the present invention for the device to have sides of different sizes so that the device fits multiple sizes of boxes and containers.

It is an object of the present invention to place a water repellent or waterproof sheet made from a material such as polyethylene underneath the device along the bottom of the box or container to protect the box or container from any water or dirt spillage from the plant holders.

It is an object of the present invention to attach a water repellent or waterproof sheet made from a material such as polyethylene to the box or container by way of a mechanism such as adhesive tape, caps or another device for attachment.

The present invention relates to a single device for securely transporting multiple potted plants or other objects having a base. The device comprises a foundation having several openings that allow the base of a plant holder or other objects having a base to sit securely within the device. The foundation has slots within it that panels fit within. It is an object of the present invention for there to be either two or four panels that then are attached to the foundation to hold the foundation above the bottom of the box or container. It is an object of the present invention for the panels to be made of different heights depending on the objects to be placed in the device.

The present invention relates to a device that comprises multiple pieces which are then placed together so that the device fits within a box or container and the device holds potted plants or objects having a base. It is an object of the present invention for each piece to contain an opening. It is an object of the present invention for each piece to contain more than one opening. It is an object of the present invention for each of the openings to have multiple slits to allow the device to retain different size plant holders or other objects having a base. It is an object of the present invention for each opening to have a different number of slits. It is an object of the present invention for the slits to be of different sizes. It is an object of the present invention for the slits to be symmetrical or asymmetrical compared to slits of other openings. It is an object of the present invention for each of the pieces to have a partial opening that when the pieces are put together that they form a further opening.

It is an object of the present invention for each piece of the device to have foldable portions so that each piece of the device can fit together and within a box or container. It is an object of the present invention for the foldable portions to have creases to assist with folding. It is an object of the present invention for each piece to have an attachment portion for attaching to other pieces or attaching to the box or container.

It is an object of the present invention for the device to be broken up into multiple pieces, i.e., two pieces, three pieces, four pieces, etc.

It is an object of the present invention for the device to be broken up into four pieces: upper left corner, upper right corner, lower right corner, and lower left corner. Each of the pieces has foldable sides. Each of the pieces has an opening and when all four pieces are put together a fifth opening is created in the middle of all four pieces. It is an object of the present invention for each of the pieces to have foldable portions to assist in placing the device in a box.

It is an object of the present invention for the plant holder or object having a base to assist in holding the piece upwards in the box or container once the plant holder or base is placed within an opening in the piece.

By separating the device into several pieces it makes the device easier to store when the device is not in use.

It is an object of the present invention for each piece of the device to comprise cardboard, paperboard or another fiber based material. It is an object of the present invention for each piece of the device to comprise plastic, or polyethylene material.

It is an object of the present invention for the device, once all the pieces are placed into the box or container to securely fit within a box or container so that the box or container can be easily moved and stored. It is an object of the present invention for the device, once all the pieces are put together to fit snugly within the box or container so that there is little or no movement of the device within the box or container so that the plants or other objects are not harmed during movement of the box or container.

It is an object of the present invention for each piece of the device to be made of a foldable material to assist with the device fitting properly within a box or container.

It is an object of the present invention for the device to further comprise a divider which is inserted into the box or container above the connected pieces of the device to separate the different plants or other objects that are placed in the openings from each other.

It is an object of the present invention for the device to have adjustable sides so that the device fits multiple sizes of boxes or containers.

It is an object of the present invention to place a water repellent or waterproof sheet made from a material such as polyethylene underneath the device along the bottom of the box or container to protect the box or container from any water or dirt spillage from the plant holders.

It is an object of the present invention to attach a water repellent or waterproof sheet made from a material such as polyethylene to the box or container by way of a mechanism such as adhesive tape, clips or another device for attachment.

It is an object of the present invention for each piece to have three sides with panels that fold down. These panels give each piece support and when put together the individual pieces support each other on the sides that they are missing panels.

The present invention relates to a device for securely transporting multiple potted plants or other objects having a base comprising; a device comprised of multiple pieces. Each of the pieces having a foldable portion(s) and each of the pieces having at least one opening. The openings are where a plant hold or other object having a base sits securely within the openings. The openings are adjustable so that different sized and shaped bases of plant holders or other objects sit securely within the openings. The pieces fit together when placed in a box or container to securely fit the device in the box or container.

DETAILED DESCRIPTION OF THE INVENTION

Figure 1:
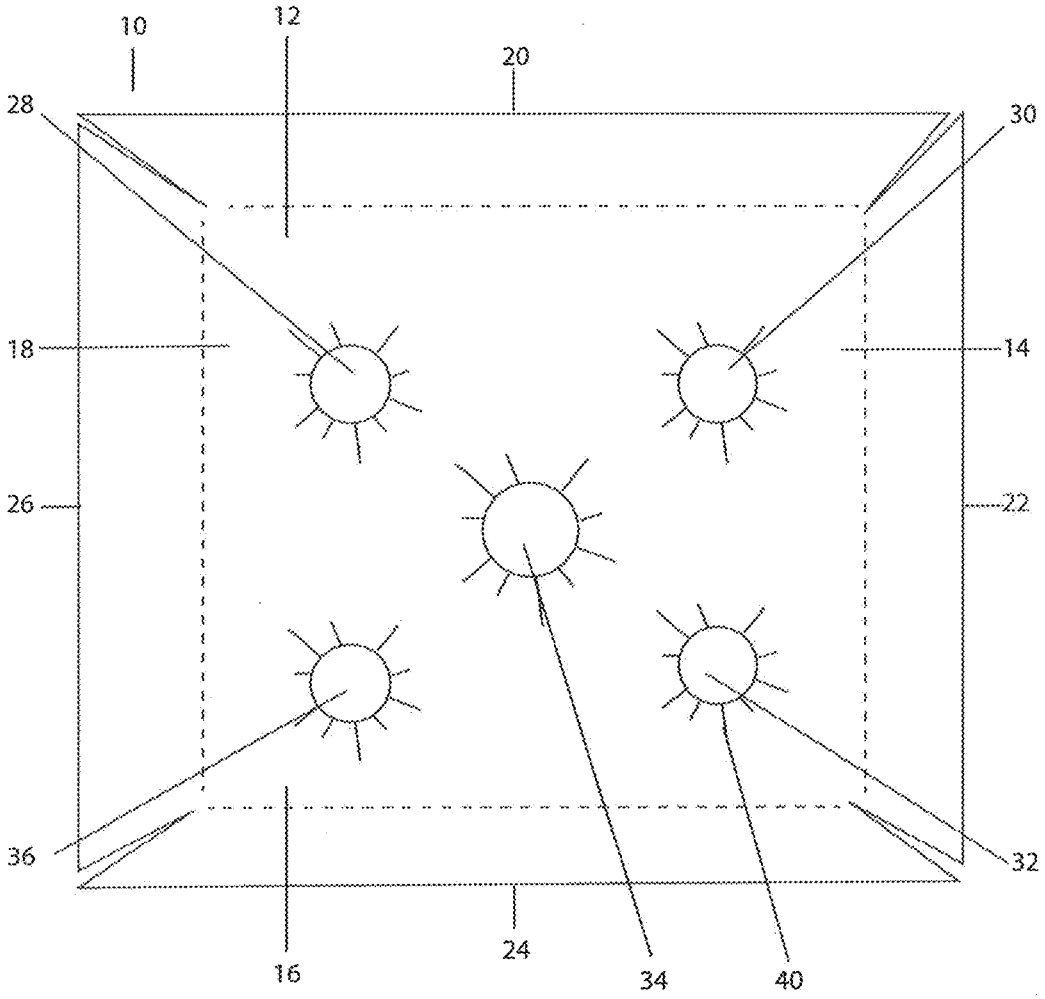
FIG. 1 is a top view of an embodiment of the device of the present invention.

FIG. 1 shows a top view of the device 10 having four sides, 12, 14, 16 and 18. Each of the sides has a foldable portion 20, 22, 24 and 26 respectfully. The device 10 is shown having five openings 28, 30, 32, 34, and 36, however any amount of openings can be placed on the device 10 so long as there is enough space for the plants or other objects to fit within the device and in a box or container. Each of the openings has multiple slits 40 which allow the device to retain different size plant holders or other objects having a base.

Figure 2:
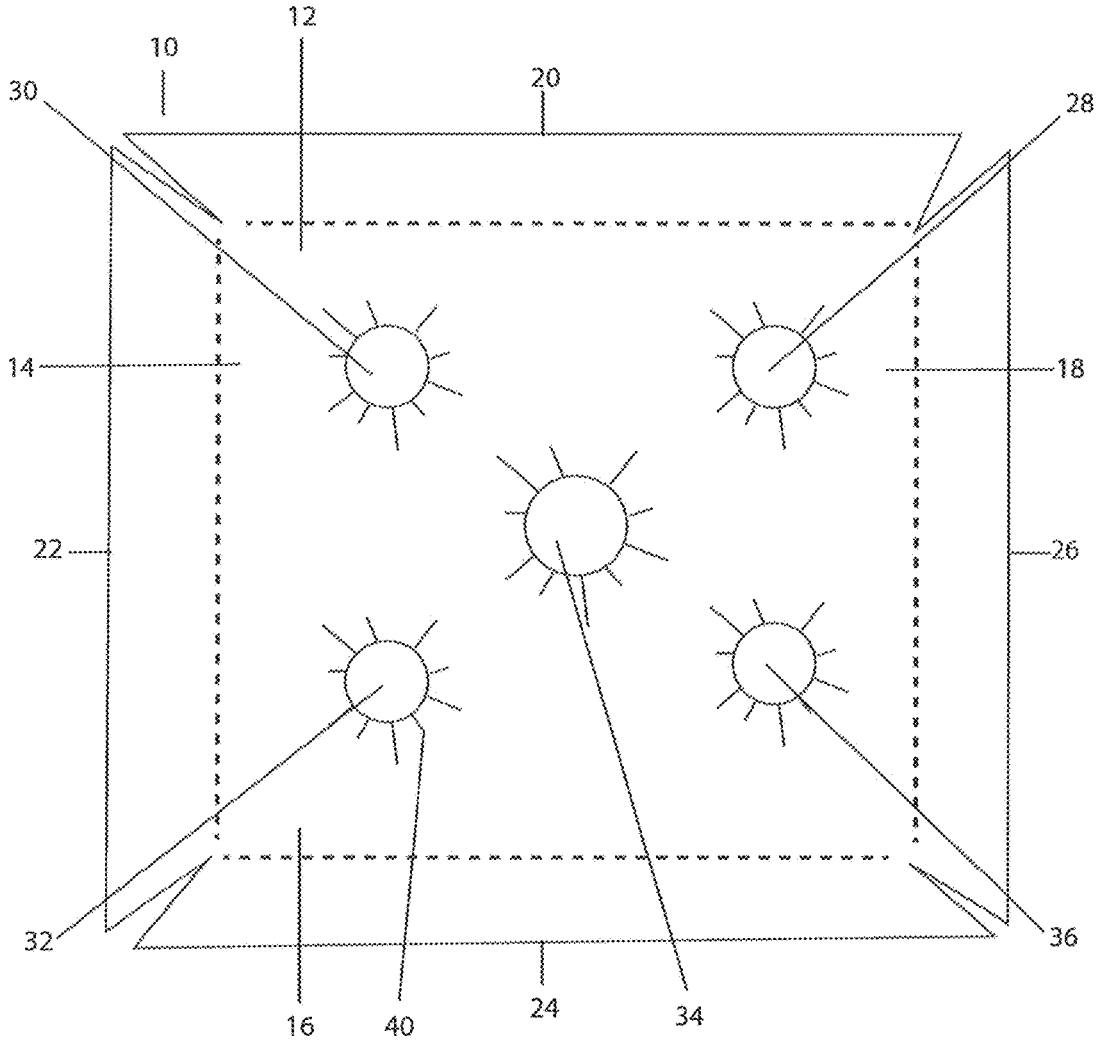
FIG. 2 is a bottom view of an embodiment of the device of the present invention.

FIG. 2 shows a bottom view of the device 10 having four sides, 12, 14, 16 and 18. Each of the sides has a foldable portion 20, 22, 24 and 26 respectfully. The device 10 is shown having five openings 28, 30, 32, 34, and 36, however any amount of openings can be placed on the device 10 so long as there is enough space for the plants or other objects to fit within the device and in the box or container. Each of the openings has multiple slits 40 which allow the device to retain different size plant holders or other objects having a base.

Figure 3:
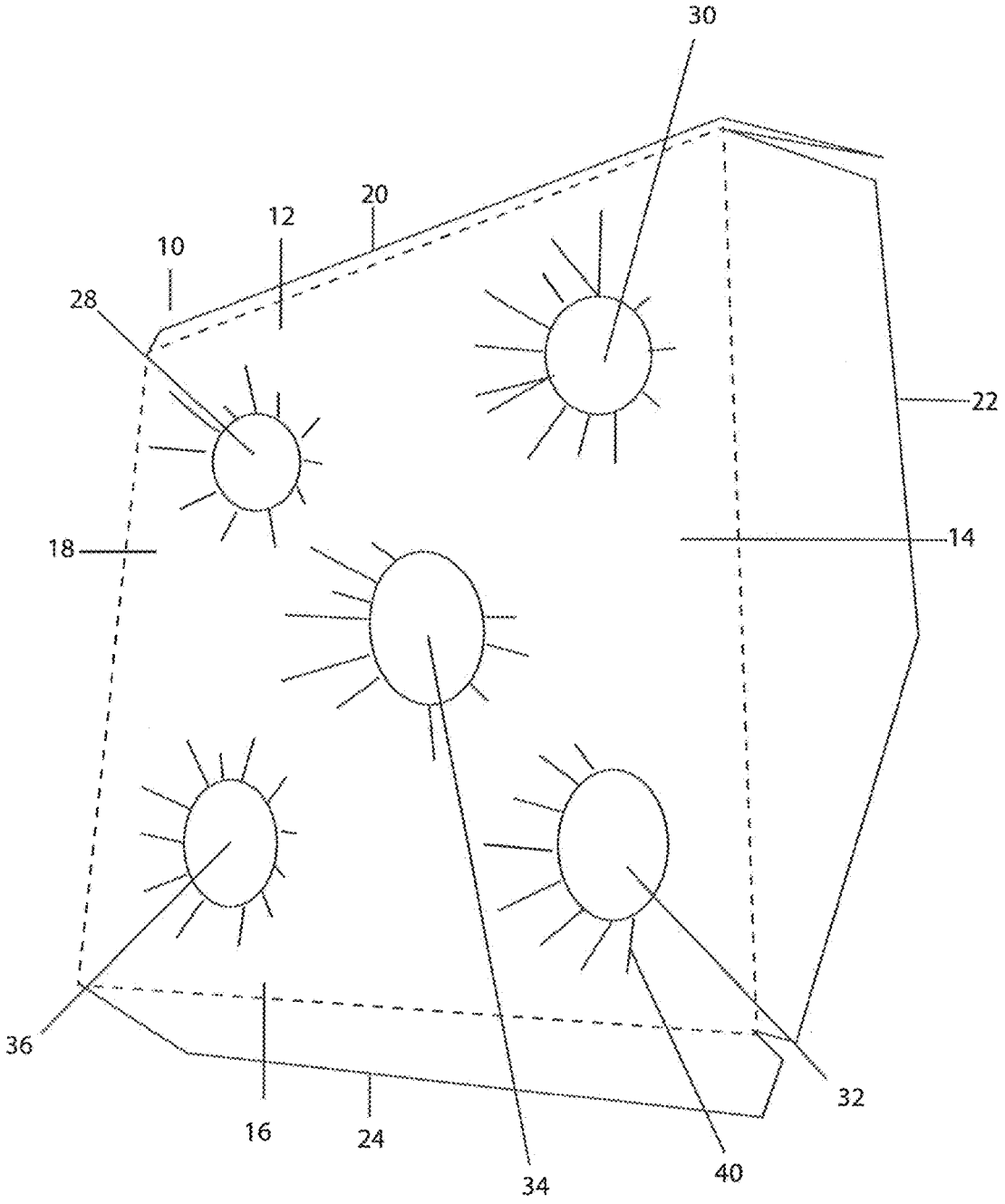
FIG. 3 is a top folded view of an embodiment of the device of the present invention.

FIG. 3 shows a top view of the folded device 10 having sides 12, 14, 16 and 18. Each of the sides has a foldable portion 22, 24 (shown) and 20, 26, (not shown). The device 10 has five openings 28, 30, 32, 34 and 36. Each of the openings has multiple slits 40 which allows the device to retain different size plant holders or other objects having a base.

Figure 4:
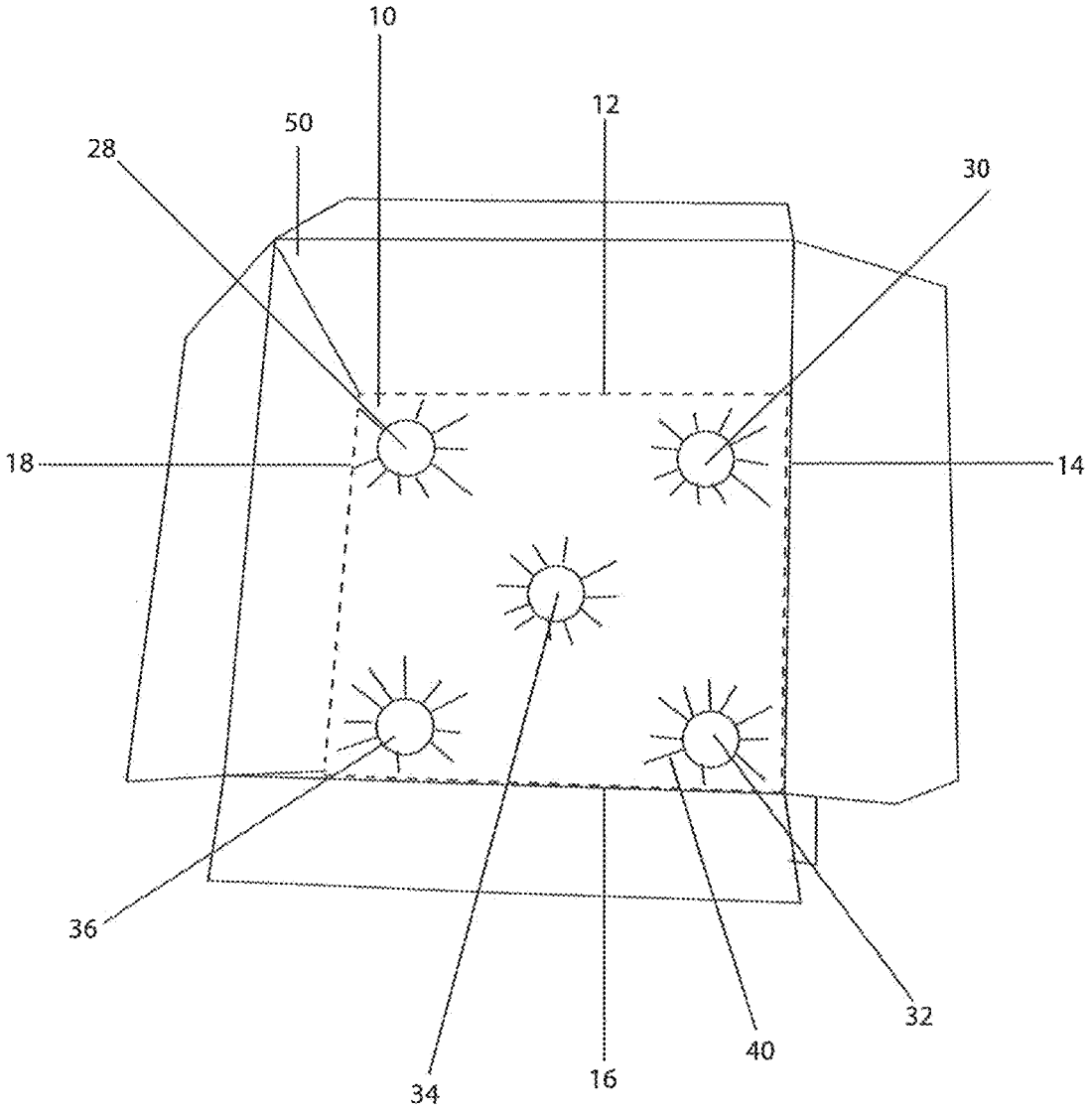
FIG. 4 is a top view of an embodiment of the device of the present invention placed in a box.

FIG. 4 shows the device 10 sitting within a box 50. The foldable portions 20, 22, 24 and 26 (not shown) of sides 12, 14, 16 and 18 fold against the sides of the box 50. The device 10 has five openings 28, 30, 32, 34 and 36. Each of the openings has multiple slits 40 which allows the device to retain different sized and shaped plant holders or other objects having a base.

Figure 5:
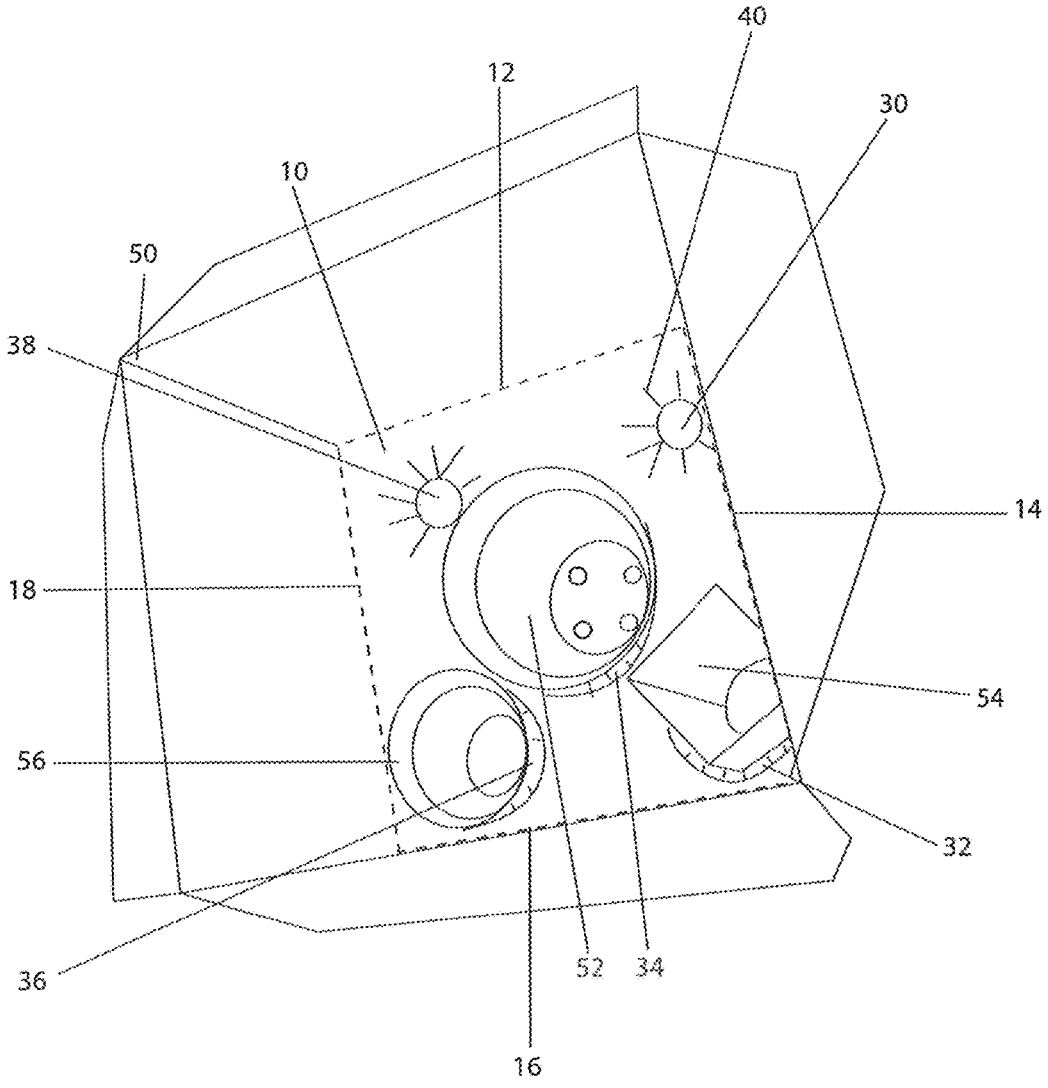
FIG. 5 is a top view of an embodiment of the device of the present invention placed in a box with pots inserted in the device.

FIG. 5 shows the device 10 inserted into a box 50. Plant holder 56 is inserted in opening 36, plant holder 54 is inserted into opening 32 and plant holder 52 is inserted into opening 34. The plant holders 56, 52 and 54 are of different sizes and different shapes.

Figure 6:
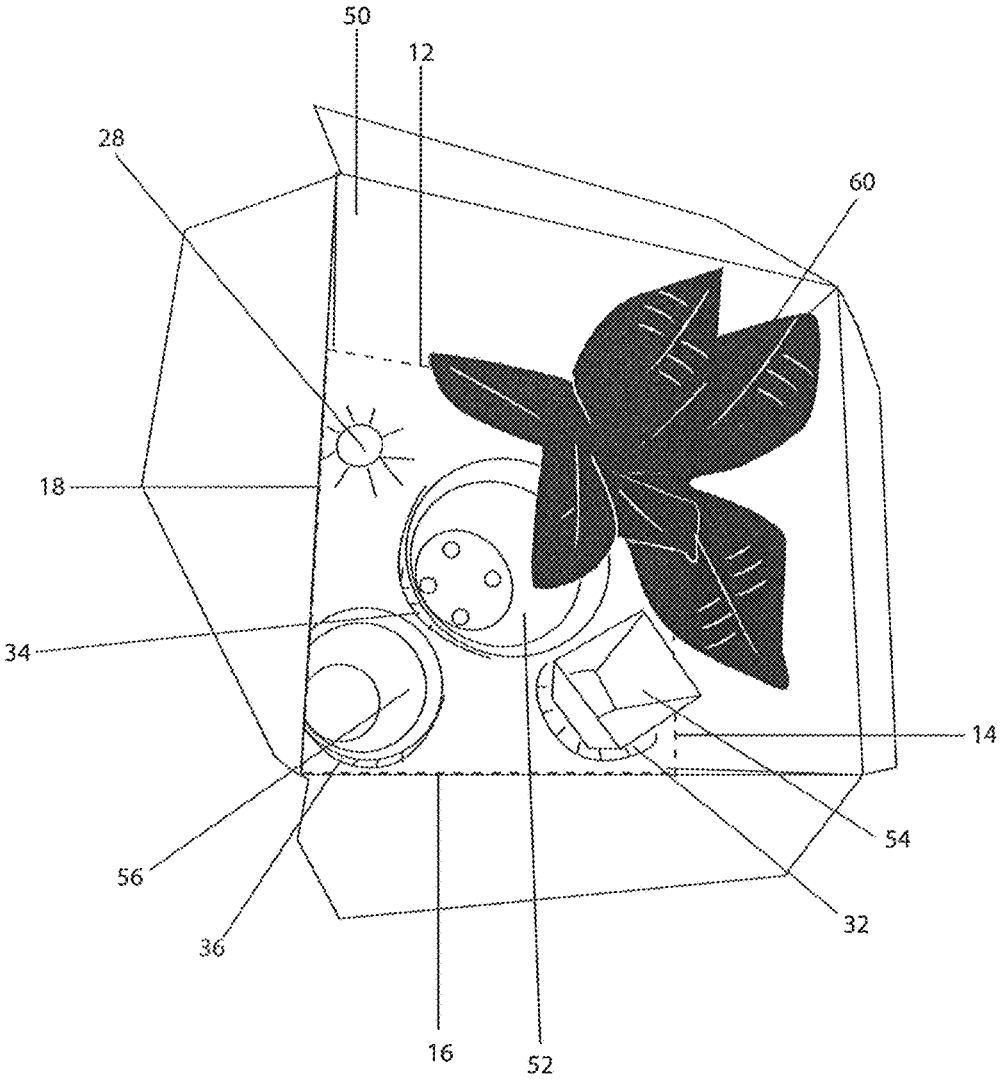
FIG. 6 is a top view of an embodiment of the device of the present invention placed in a box with plant holders and plant holders having plants inserted in the device.

FIG. 6 shows the device 10 within box 50. Plant holders 56, 52 and 54 are placed in openings 36, 34 and 32 respectively. Plant 60 is in a plant holder within opening 30 which is not shown.

Figure 7:
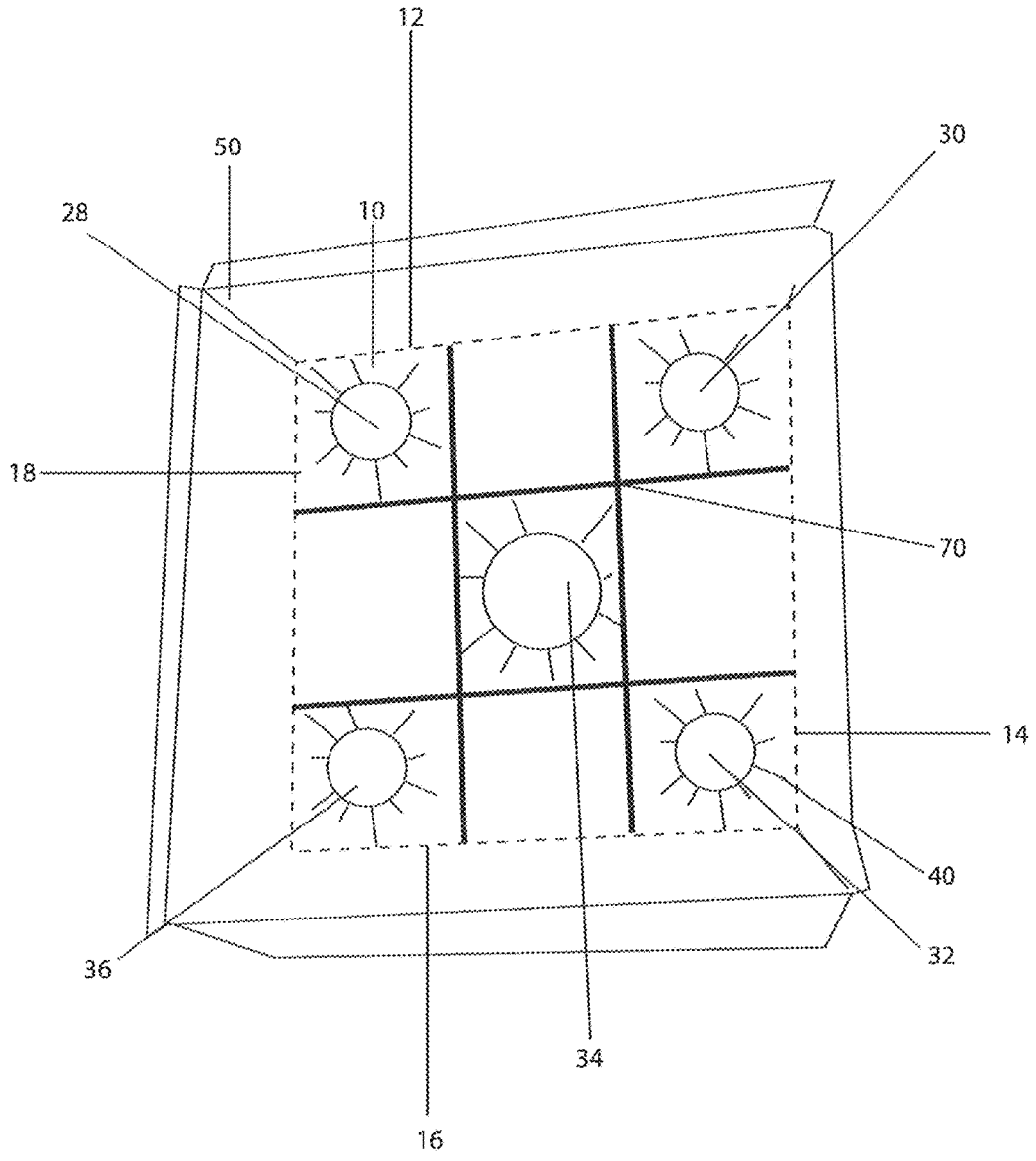
FIG. 7 is a top view of an embodiment of the device of the present invention placed in a box.

FIG. 7 shows the device 10 sitting within a box 50. The foldable portions 20, 22, 24 and 26 (not shown) of sides 12, 14, 16 and 18 fold against the sides of the box 50. The device 10 has five openings 28, 30, 32, 34 and 36. Each of the openings has multiple slits 40 which allows the device to retain different sized and shaped plant holders and other objects having a base. The box 50 further contains divider 70 which provides separation between the different plants and other objects that are placed in the openings.

Figure 8:
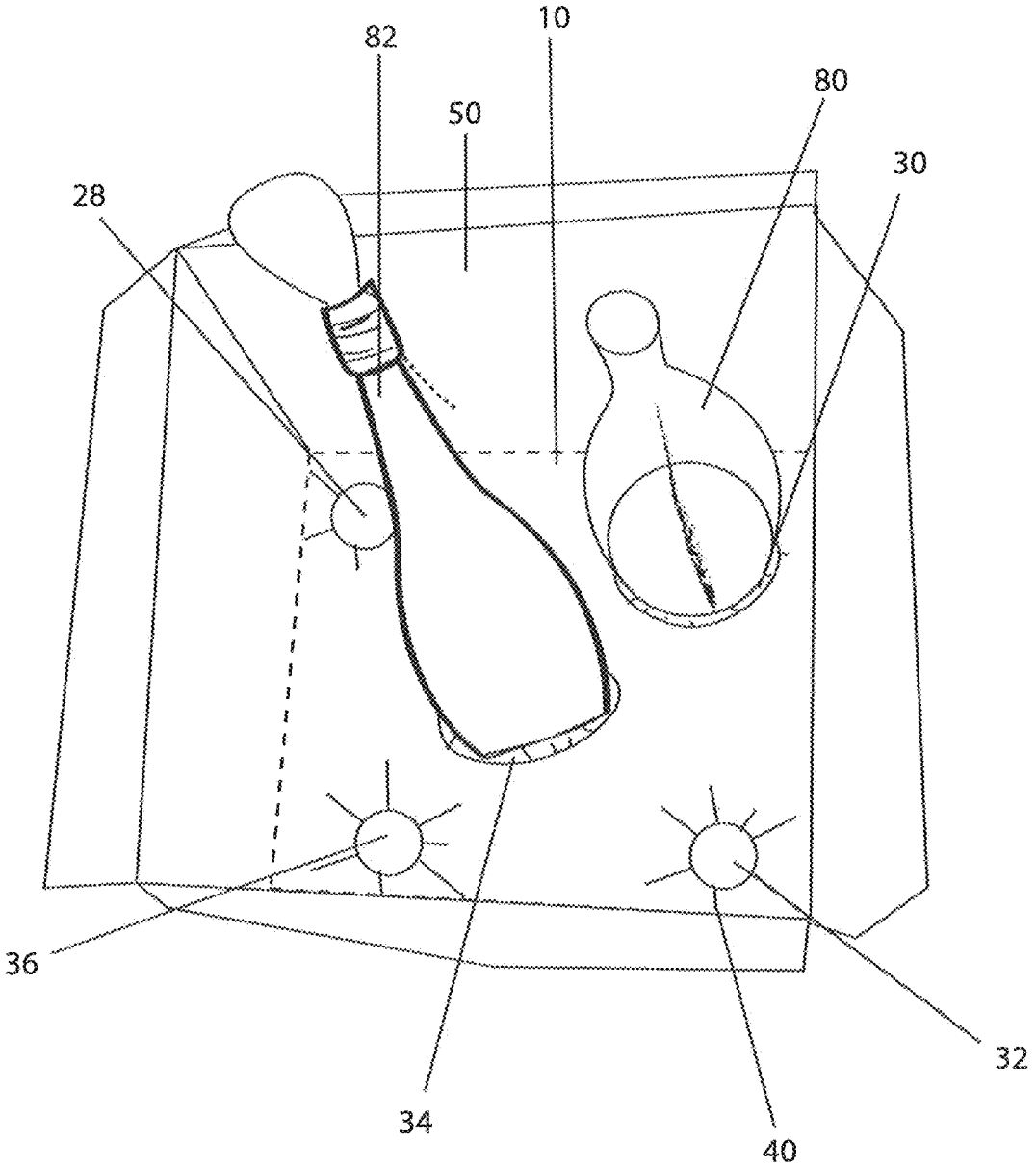
FIG. 8 is a top view of an embodiment of the device of the present invention placed in a box with a vase and lamp inserted in the device.

FIG. 8 shows the device 10 sitting within a box 50. The device 10 has five openings 28, 30, 32, 34 and 36. Each of the openings has multiple slits 40 which allows the device 10 to retain different sized and shaped plant holders and other objects having a base. A vase 80 is placed in opening 30. A lamp 82 is placed in opening 34.

Figure 9:
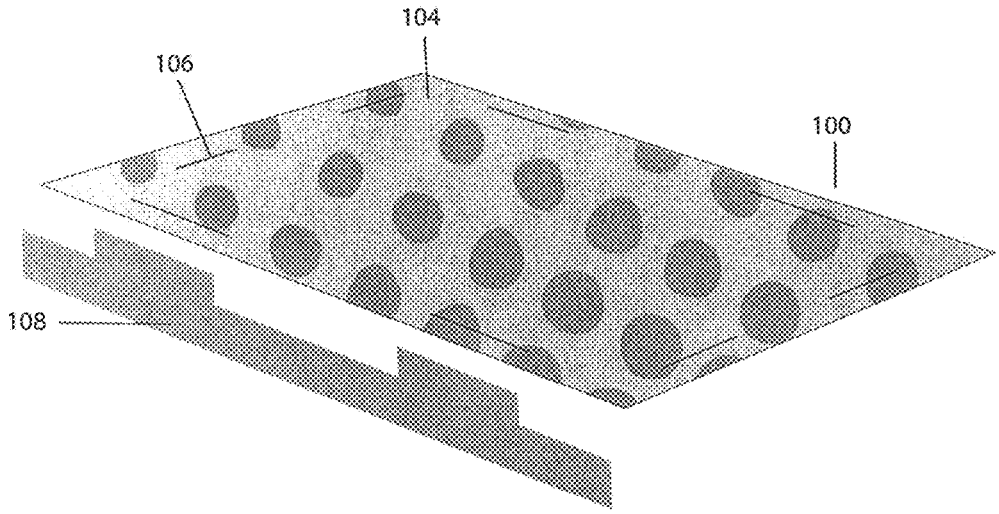
FIG. 9 is a side view of an embodiment of the device of the present invention.

FIG. 9 shows the device 100. The device 100 has a foundation 104 which has slots 106 where the panels 108 fits in to support the device 100.

Figure 10:
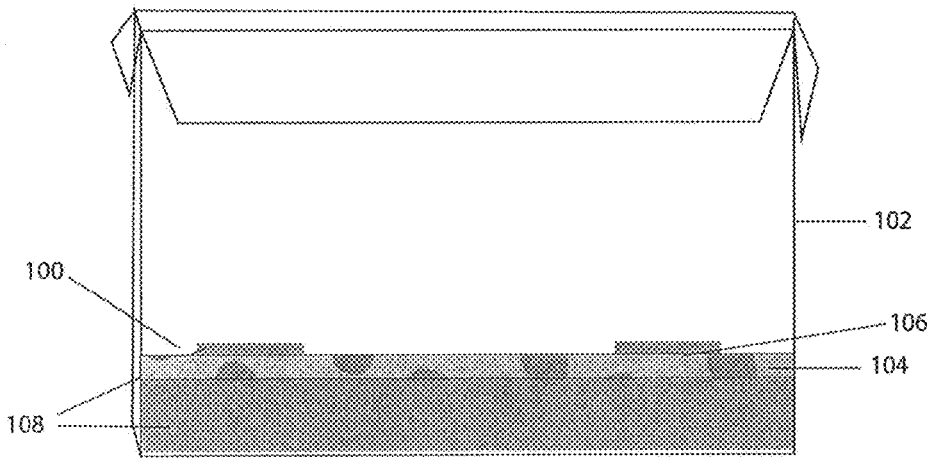
FIG. 10 is a side view through the box of an embodiment of the device of the present invention placed in a box.

FIG. 10 shows the device 100 being in a box 102, the device 100 having a foundation 104 having slots 106. The device 100 has panels 108 placed through the slots 106 to support the device 100.

Figure 11:
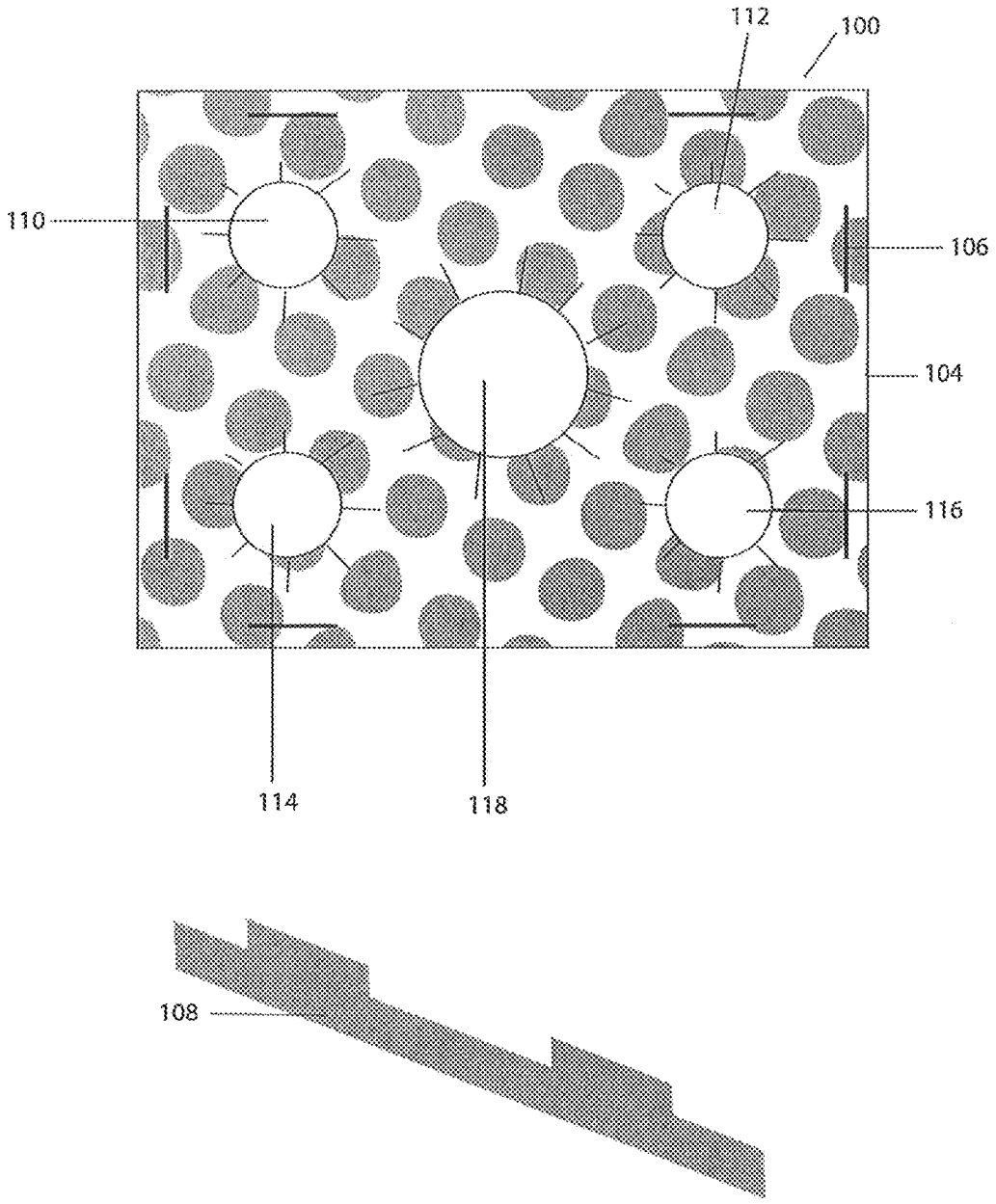
FIG. 11 is a top view of an embodiment of the device of the present invention.

FIG. 11 shows the device 100 having a foundation 104. The foundation 104 has slots 106 that is where the panels 108 are placed through. The foundation 104 has openings 110, 112, 114, 116 and 118.

Figure 12:
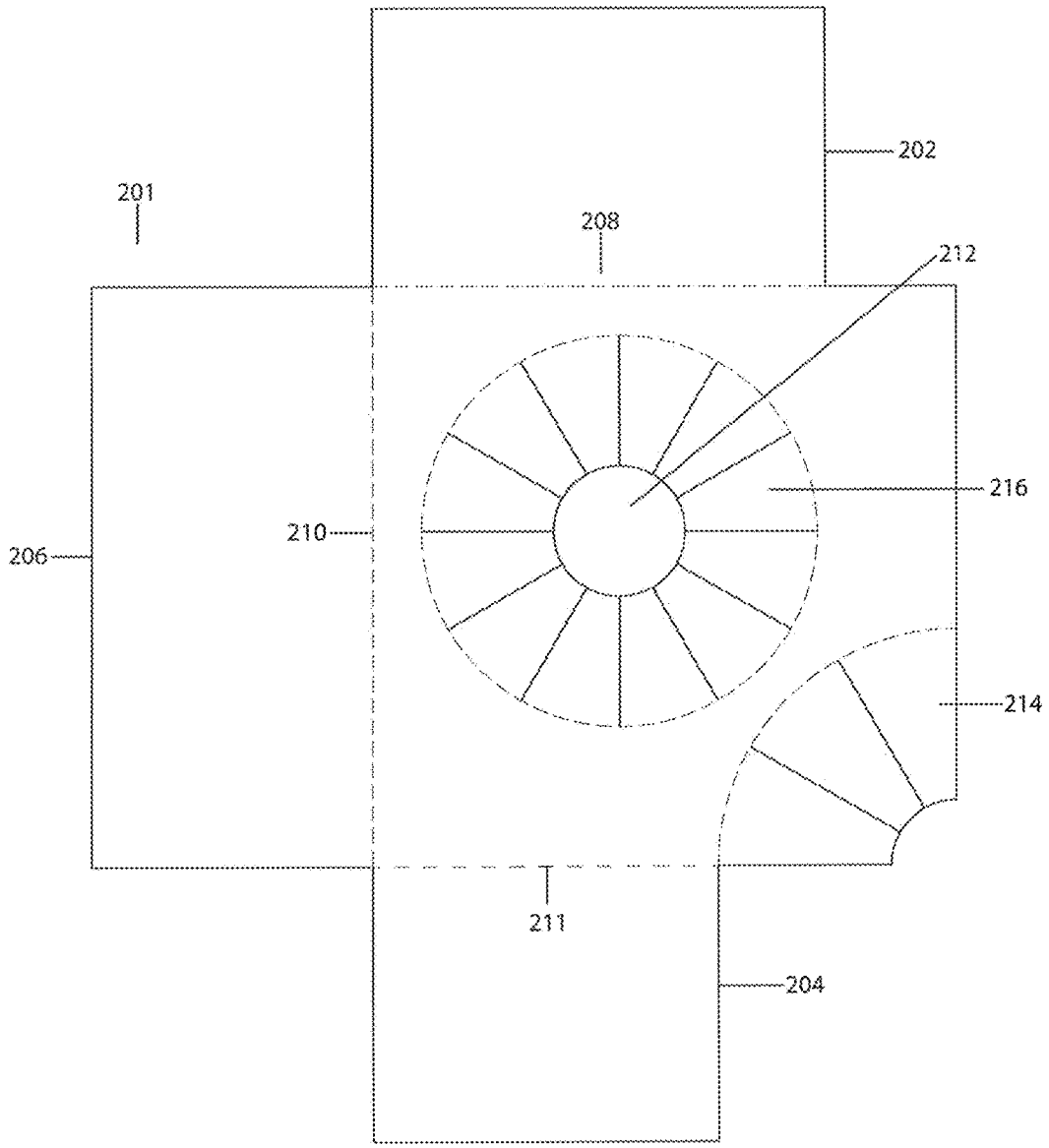
FIG. 12 is a top view of a piece of FIG. 13 of the present invention.
Figure 13:
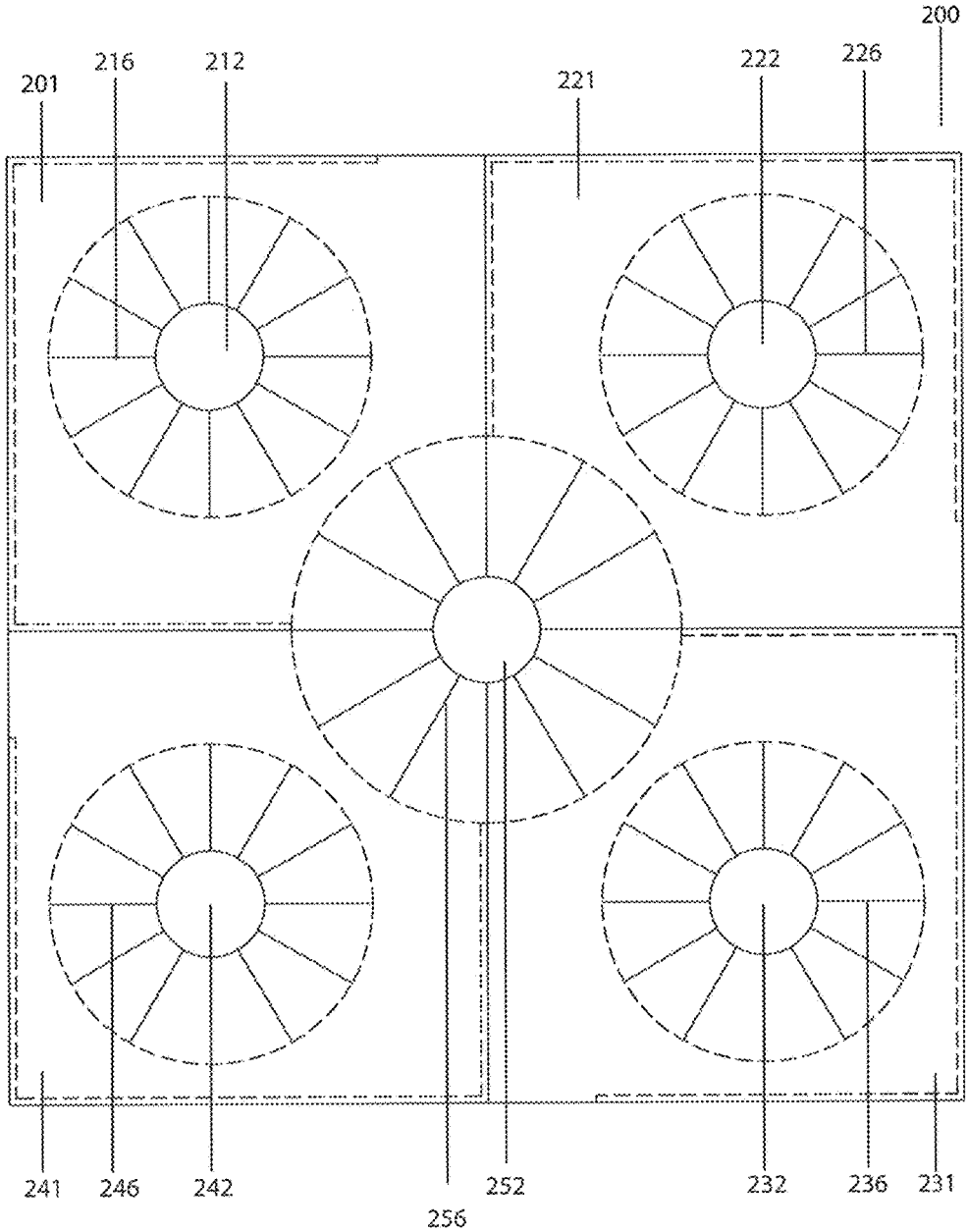
FIG. 13 is a top view of an embodiment of the device of the present invention.

FIG. 12 shows a piece 201 of the device 200, shown in FIG. 13, having foldable portions 202, 204 and 206. The foldable portion 202 is foldable along crease 208. The foldable portion 206 is foldable along crease 210. The foldable portion 204 is foldable along crease 211. Piece 201 has an opening 212 having slits 216. The opening 212 has multiple slits 216 which allow the opening 212 to retain different size plant holders or other objects having a base.

The device 200 further includes a partial opening 214 which when joined with other pieces of the device, 221, 231 and 241 shown in FIG. 13, creates an opening similar to opening 212.

FIG. 13 shows a top view of the device 200. The device 200 is broken up into four pieces, upper left corner 201, upper right corner 221, lower right corner 231, and lower left corner 241. The device 200 is shown having five openings 212, 222, 232, 242 and 252. Each of the openings has multiple slits 216, 226, 236, 246 and 256 respectively, which allow each opening to retain different size plant holders or other objects having a base. The opening 252 is made by placing each of the pieces 201, 221, 231 and 241 together. Each piece 201, 221, 231 and 241 has foldable portions to assist in placing the device 200 in a box.

Figure 14:
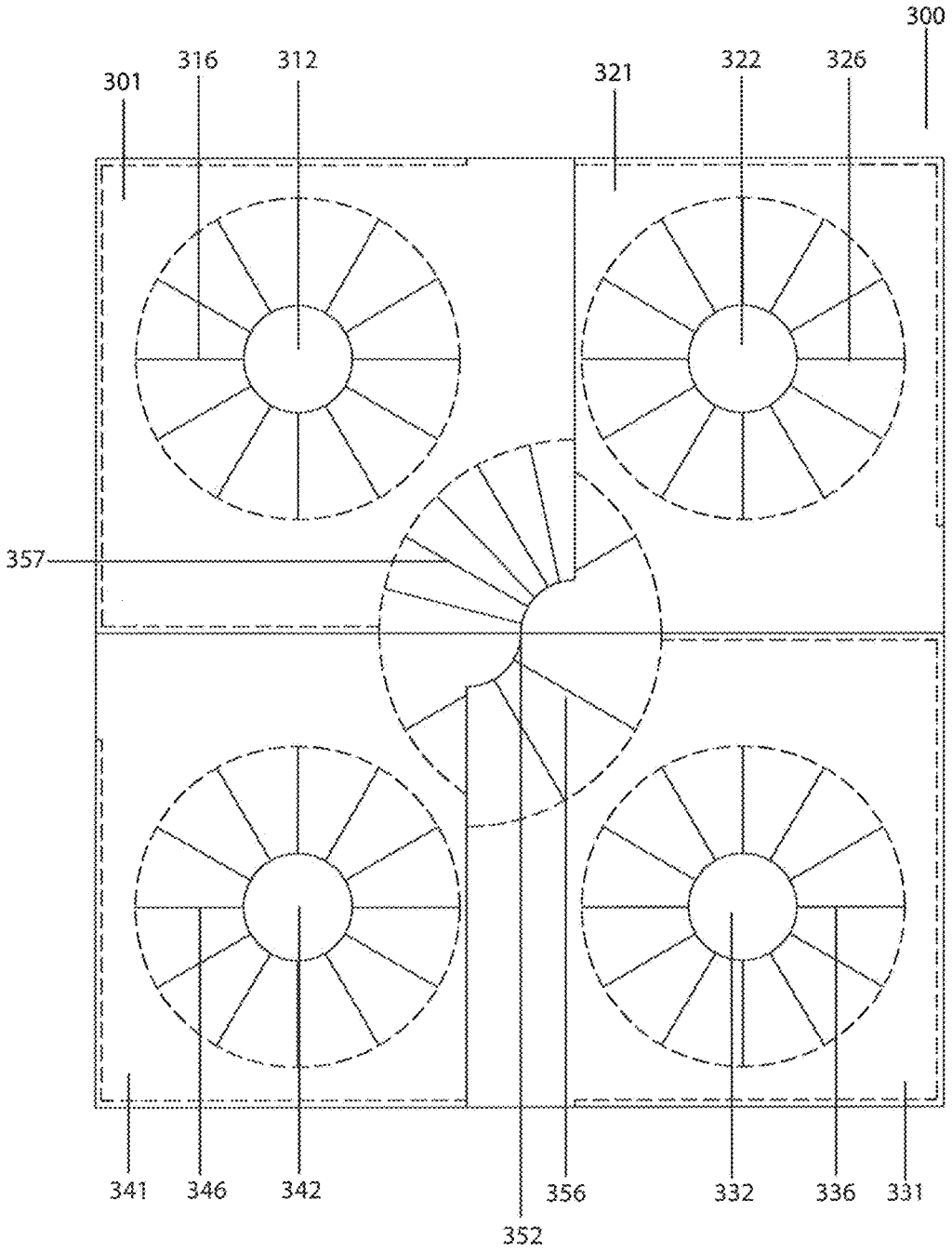
FIG. 14 is a top view of an embodiment of the device of the present invention.

FIG. 14 shows a top view of the device 300. The device is broken up into four pieces, upper left corner 301, upper right corner 321, lower right corner 331, and lower left corner 341. The pieces 301, 321, 331 and 341 are not of the same size. The device 300 is shown having five openings 312, 322, 332, 342 and 352. Each of the openings has multiple slits 316, 326, 336, 346 which allow each opening to retain different size plant holders or other objects having a base. Opening 352, an irregular shaped opening, is created by the pieces 301, 321, 331 and 341 which also creates the slits 356 and 351, which shows slits of different size and shape, which allow the opening to retain different size plant holders or other objects having a base. The opening 352 is made by placing each of the pieces 301, 321, 331 and 341 together. Each piece 301, 321, 331 and 341 has foldable portions to assist in placing the device 300 in a box.

Figure 15:
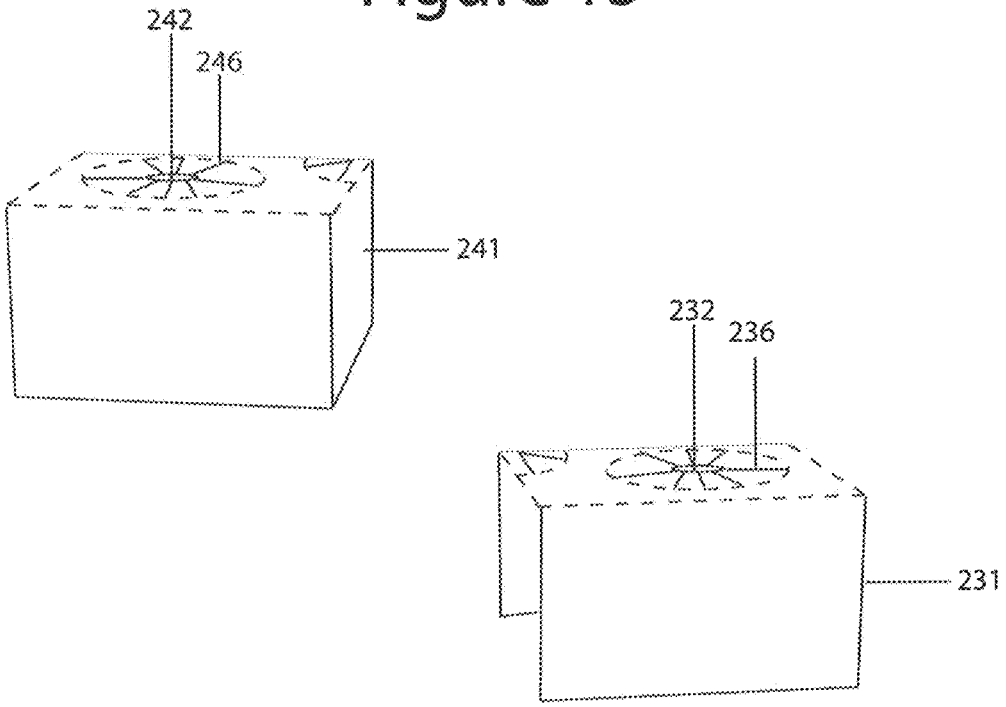
FIG. 15 is a side view of an embodiment of separate pieces of the device of the present invention.

FIG. 15 shows a side view of two pieces 241 and 231 of the device 200 showing the folding portions. FIG. 15 shows the pieces 241 and 231 separated and folded along their creases, each having their respective openings 242, and 232 with respective slits 246 and 236, and each having a partial opening.

Figure 16:
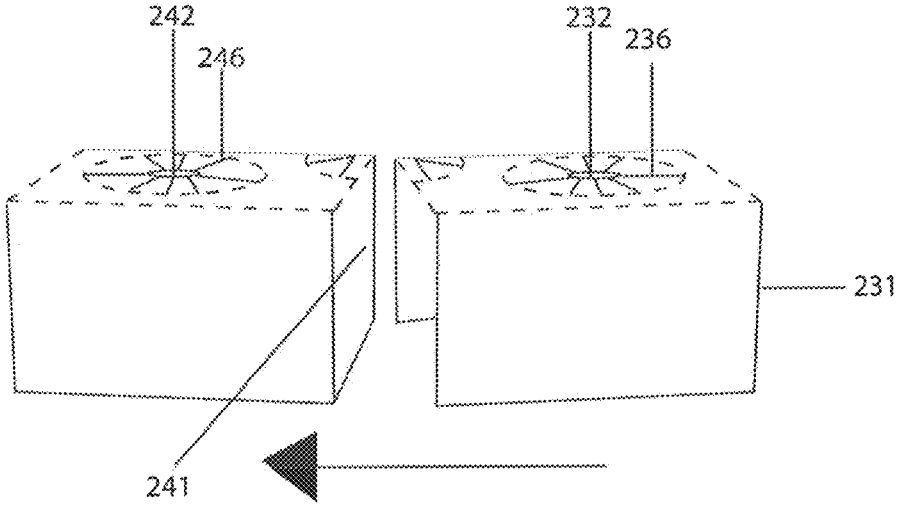
FIG. 16 is a further side view of FIG. 15 wherein the separate pieces of the device of the present invention are put together.

FIG. 16 shows a side view of two pieces of 241 and 231 of the device 200 showing the folded portions, wherein the two pieces are placed together to form the device 200. FIG. 16 shows the pieces 241 and 231 folded along their crease, each having their respective openings 242, and 232 with slits 246 and 236, and each having a partial opening.

Figure 17:
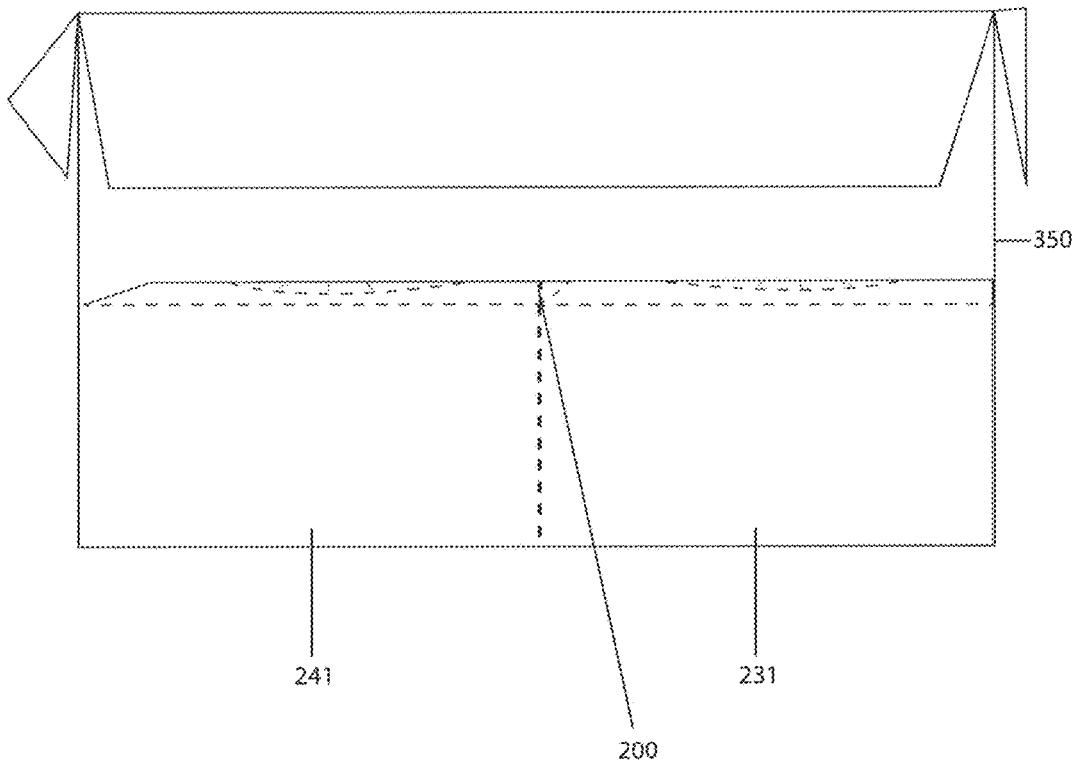
FIG. 17 is a side view through the box of the pieces of the device of FIG. 15 put together in a box.

FIG. 17 shows the device 200 placed in a box 350. The device 200 has shown pieces 241 and 231 placed together to allow the device 200 to fit inside the box 350 securely, and supported.

Figure 18:
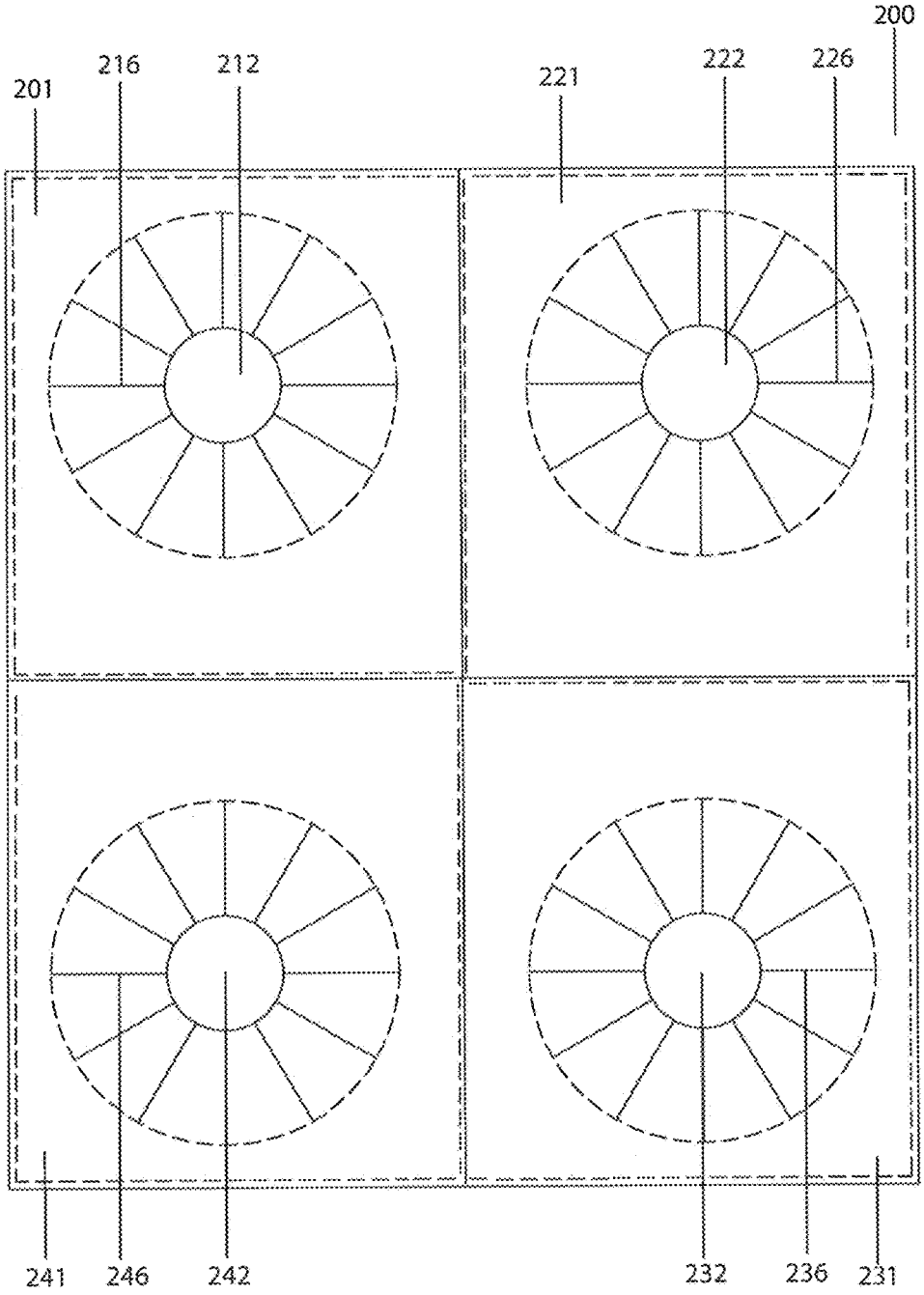
FIG. 18 is a top view of an embodiment of the device of the present invention.

FIG. 18 shows a top view of the device 200. The device 200 is broken up into four pieces, upper left corner 201, upper right corner 221, lower right corner 231, and lower left corner 241. The device 200 is shown having four openings 212, 222, 232 and 242. Each of the openings has multiple slots 216, 226, 236 and 246 respectively which allow each opening to retain difference size plant holders or other objects having a base. Each piece 201, 221, 231 and 241 has foldable portions to assist in placing the device 200 in a box.

The invention claimed is:

1. A device for securely transporting multiple objects each having a base comprising:

said device comprised of multiple unattached, distinct pieces;

each of said pieces having at least one foldable portion;

each of said pieces having an opening sized to receive an object having a base;

a corner of each of said pieces forms a portion of another opening, when all of said pieces are abutted, said another opening is sized to receive an object having a base;

said multiple pieces together abutting each other and in substantially same plane;

said openings where an object having a base sits securely within one of said openings;

said openings having an adjustable feature so that different sized and shaped bases of objects sit securely within said openings.

2. The device of claim 1 wherein each said at least one foldable portion is created by a crease in its respective said piece.

3. The device of claim 1 wherein at least one of said pieces has more than one opening.

4. The device of claim 1 wherein said multiple pieces comprise an upper right corner, upper left corner, lower left corner, and lower right corner.

5. The device of claim 1 wherein said device is comprised of fiber based material.

6. The device of claim 1 wherein said device is comprised of a plastic material.

7. The device of claim 1 wherein said device placed in a container fits securely within said container.

8. The device of claim 7 wherein said device further comprises a divider located above said pieces which physically separates the objects from each other.

9. The device of claim 7 wherein said device has little or no movement within said container so plants in a plant holder placed in an opening in said device are not harmed during movement of said container.

10. The device of claim 7 wherein a water repellant or waterproof sheet is placed on a bottom of said container.

11. The device of claim 10 wherein said sheet comprises polyethylene.

12. The device of claim 10 wherein said sheet is attached to said container by an attachment mechanism.

13. The device of claim 12 wherein said mechanism comprises adhesive tape or clips.

14. The device of claim 7 wherein each of said pieces has an attachment mechanism for attaching each of said pieces to said container or to other pieces.

15. The device of claim 1 wherein said device is waterproof.

16. The device of claim 1 wherein each object is a plant holder.

17. The device of claim 16 wherein said device is cleaned of dirt from the plant holders.

18. The device of claim 1 wherein each of said openings contains multiple slits which are adjustable.

19. The device of claim 18 wherein said slits are of different sizes.

20. The device of claim 18 wherein each of said openings has a different number of said slits.

21. The device of claim 1 wherein said device is made of a foldable material.

22. The device of claim 1 wherein said device has adjustable sides so that said device fits multiple sizes of containers.

23. The device of claim 1 wherein said further opening is an irregular opening being non-symmetrical.

24. The device of claim 1 wherein each of said pieces is of a different size.

25. The device of claim 1 wherein each of said pieces comprises three sides with panels that fold down.

26. A device for securely transporting multiple objects having a base comprising;

said device comprised of multiple unattached, distinct separate pieces;

each of said pieces having at least one foldable portion;

each of said pieces having at least one opening sized to receive an object having a base;

said multiple pieces together abutting each other in substantially the same plane;

said at least one openings where the object having a base sits securely within said at least one opening;

said openings having an adjustable feature so that different sized and shaped bases of other objects sit securely within said openings;

said pieces fitting together in a container to securely fit said device in said container.

* * * * *